US007131774B2

(12) United States Patent
Redman et al.

(10) Patent No.: US 7,131,774 B2
(45) Date of Patent: Nov. 7, 2006

(54) SELF-ALIGNING PRINT HEAD MECHANISM AND RELATED PRINTER AND METHOD

(75) Inventors: Randall L. Redman, Beavercreek, OH (US); Kinred Bowling, Dayton, OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 10/812,682

(22) Filed: Mar. 30, 2004

(65) Prior Publication Data

US 2005/0226664 A1 Oct. 13, 2005

(51) Int. Cl.
*B41J 11/20* (2006.01)

(52) U.S. Cl. ..... 400/58; 400/59; 400/649

(58) Field of Classification Search ..... 400/55–59, 400/649, 650

See application file for complete search history.

(56) References Cited

U.S. PATENT DOCUMENTS

| | | | | |
|---|---|---|---|---|
| 4,048,913 | A | | 9/1977 | Navi |
| 4,208,964 | A | | 6/1980 | Sato |
| 4,235,555 | A | | 11/1980 | Aprato |
| 4,365,900 | A | * | 12/1982 | Gottsmann et al. ..... 400/57 |
| 4,758,844 | A | * | 7/1988 | Takei et al. ..... 346/74.4 |
| 5,013,387 | A | | 5/1991 | Goodwin et al. |
| 5,114,251 | A | | 5/1992 | Mahoney |
| 5,388,919 | A | | 2/1995 | Kimura et al. |
| 5,414,450 | A | | 5/1995 | Oshino et al. |
| 5,473,984 | A | | 12/1995 | Terrell, Jr. et al. |
| 5,541,635 | A | | 7/1996 | Wills et al. |
| 5,599,113 | A | | 2/1997 | Suzuki et al. |
| 5,615,960 | A | | 4/1997 | Mori et al. |
| 5,694,159 | A | | 12/1997 | Kajiya et al. |
| 5,717,444 | A | | 2/1998 | Sugimoto et al. |
| 5,882,126 | A | | 3/1999 | Bowling |
| 5,918,990 | A | * | 7/1999 | Abumehdi ..... 400/120.17 |
| 5,997,192 | A | * | 12/1999 | Martinez et al. ..... 400/58 |
| 6,259,808 | B1 | * | 7/2001 | Martinez et al. ..... 382/139 |
| 6,350,070 | B1 | | 2/2002 | Tasma |
| 6,663,302 | B1 | * | 12/2003 | Kelley et al. ..... 400/59 |
| 6,758,614 | B1 | * | 7/2004 | Yamada et al. ..... 400/58 |

FOREIGN PATENT DOCUMENTS

| | | |
|---|---|---|
| JP | 63272578 | 11/1988 |
| JP | 1136773 | 5/1989 |

* cited by examiner

*Primary Examiner*—Andrew H. Hirshfeld
*Assistant Examiner*—Dave A. Ghatt
(74) *Attorney, Agent, or Firm*—Thompson Hine LLP

(57) ABSTRACT

A printer for printing between a print roller and a print head having a print head alignment system is provided. The print head alignment system includes a print roller assembly, a print head support assembly and an actuating assembly. The print roller assembly includes at least one stop and a print roller mounted thereto. The print head support assembly includes a print head mounted thereto and at least one detent, a surface of the detent engaging a surface of the stop to maintain alignment of the print head with the print roller. The actuating assembly is associated with one of the print head support assembly and the print roller assembly to separate the detent and the stop before moving one the print head and print roller to provide an access space between the print head and the print roller for allowing print media to be removed and inserted.

23 Claims, 6 Drawing Sheets

SELF-ALIGNING PRINT HEAD MECHANISM AND RELATED PRINTER AND METHOD

TECHNICAL FIELD

The present invention relates to printers and, more particularly, to printers that utilize a print head alignment system.

BACKGROUND

Printers are used for marking various indicia on labels and the like. Label stock or other print media moves through the printer such that it passes between a print head and a print roller whereby the label stock is marked by the print head. As the label stock continuously moves through the printer, pieces of the label stock may become jammed between the print roller and the print head, making them difficult to remove. Furthermore, in many applications a variety of types of label stock are used, creating a need for the ability to easily remove and replace label stock. At the same time, maintaining proper alignment and relatively uniform pressure between the print roller and print head during printing is important to print quality.

Accordingly, there is a need for a printer having a print head alignment system such that the print head may be properly aligned with the print roller while at the same time allowing for an access space to be created between the print head and the print roller.

SUMMARY

In one aspect, a printer for printing between a print roller and a print head includes a print head alignment system. A print roller assembly has a print roller mounted thereon and at least one stop. A print head support assembly has a print head mounted thereon and at least one detent, a surface of said detent engaging a surface of said stop to maintain alignment of said print head with said print head roller. An actuating assembly is associated with one of said print head support assembly and said print roller assembly for movement thereof so as to back one of the detent and the stop away from the other of the detent and the stop before moving the one of the print head support assembly and the print roller assembly so as to provide an access space between said print head and said print roller for allowing print media to be removed and inserted.

In another aspect, a print head alignment system is provided that includes a frame, a print roller support extending from the frame and having at least one stop and a print roller, and a print head support assembly including a pivot frame pivotally attached at one end to pivot around a pivot axis, two spaced apart wheels rotatably attached to the pivot frame and a heat sink supporting a print head and having at least one detent. The heat sink is mounted for movement relative to the pivot frame to permit a distance between the print head and the pivot axis to be varied. A print head elevator having two spaced apart rails is also provided for supporting the spaced apart wheels. Each of the spaced apart rails includes a respective ramp portion. The print head elevator is movable relative to the pivot frame in a first direction causing the wheels to ride up the ramp portion to elevate the print head and heat sink and place the at least one detent into vertical alignment with the at least one stop.

In still another aspect, a method for disengaging a print head support assembly from a print roller assembly wherein the print roller assembly includes at least one substantially vertical stop surface engaged with at least one substantially vertical detent surface of the print head support assembly maintaining alignment of the print head and print roller is provided. The method includes a first step of moving one of said print head support assembly and said print roller assembly in a first direction to space said detent surface from said stop surface. A second step involves moving at least one side of said one of said print head support assembly and said print roller assembly in a second direction away from the other of said print head support assembly and said print roller assembly to provide an access space between said print head and said print roller for allowing print media to be removed and inserted.

BRIEF DESCRIPTION OF THE DRAWINGS

The invention can be understood with respect to the following drawings. In the drawings, like referenced numerals designate corresponding parts throughout the several views. Also, the components in the drawings are not necessarily to scale.

DETAILED DESCRIPTION

Figure 1:
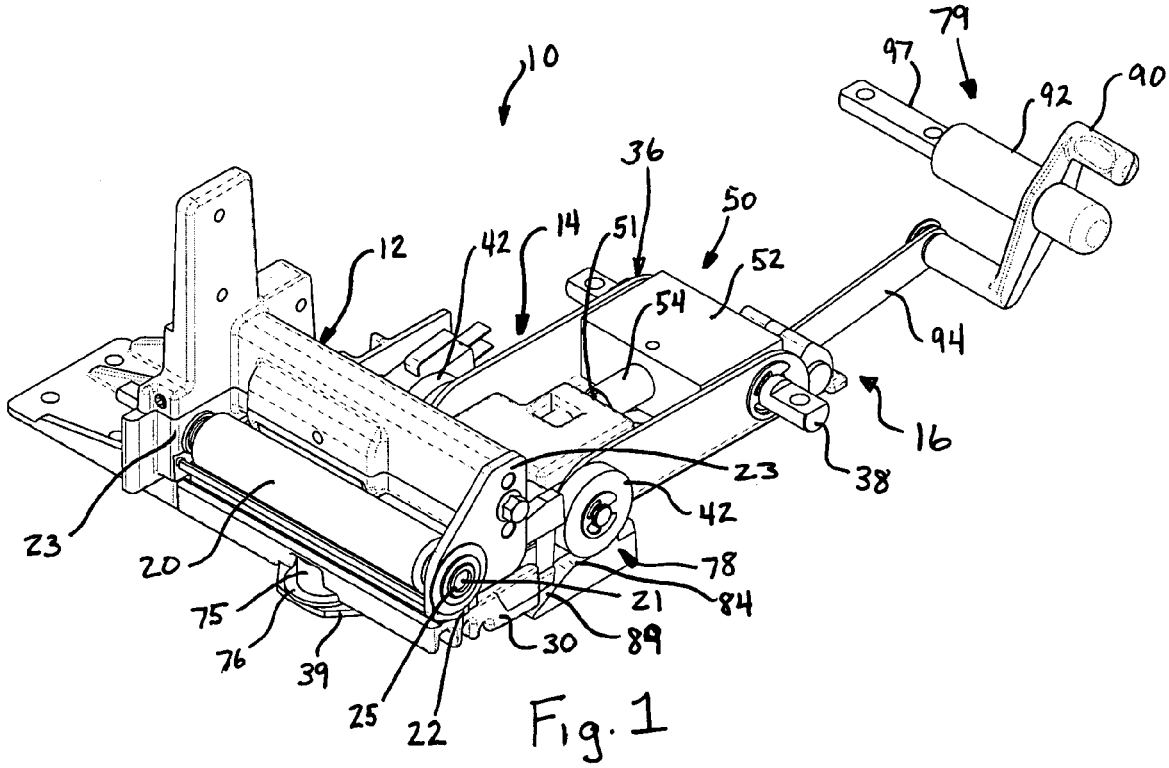
FIG. 1 is a front perspective view of the print head alignment system of the present invention.
Figure 4:
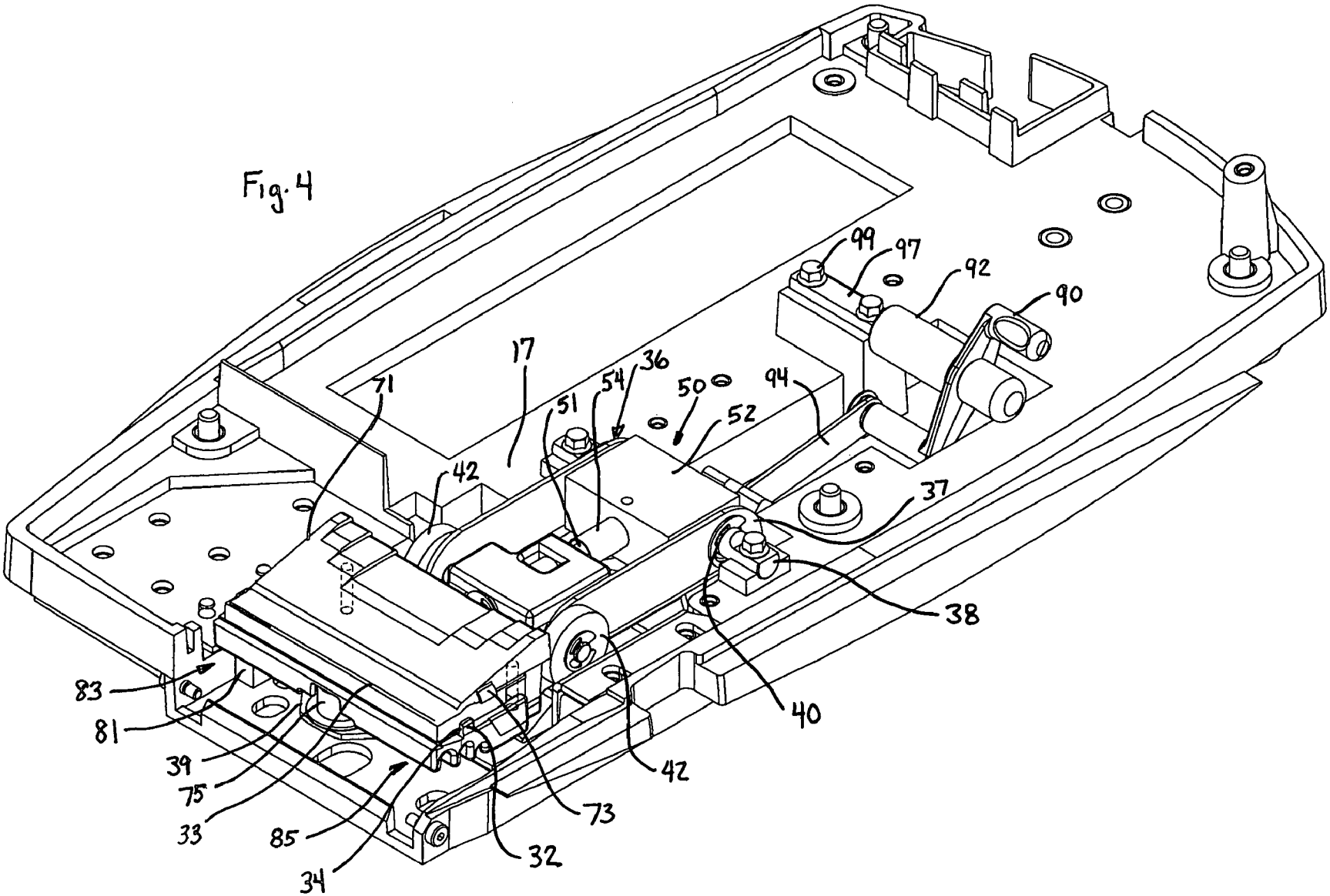
FIG. 4 is a front perspective view of the print head alignment system of FIG. 2 positioned in a printer frame.
Figure 5:
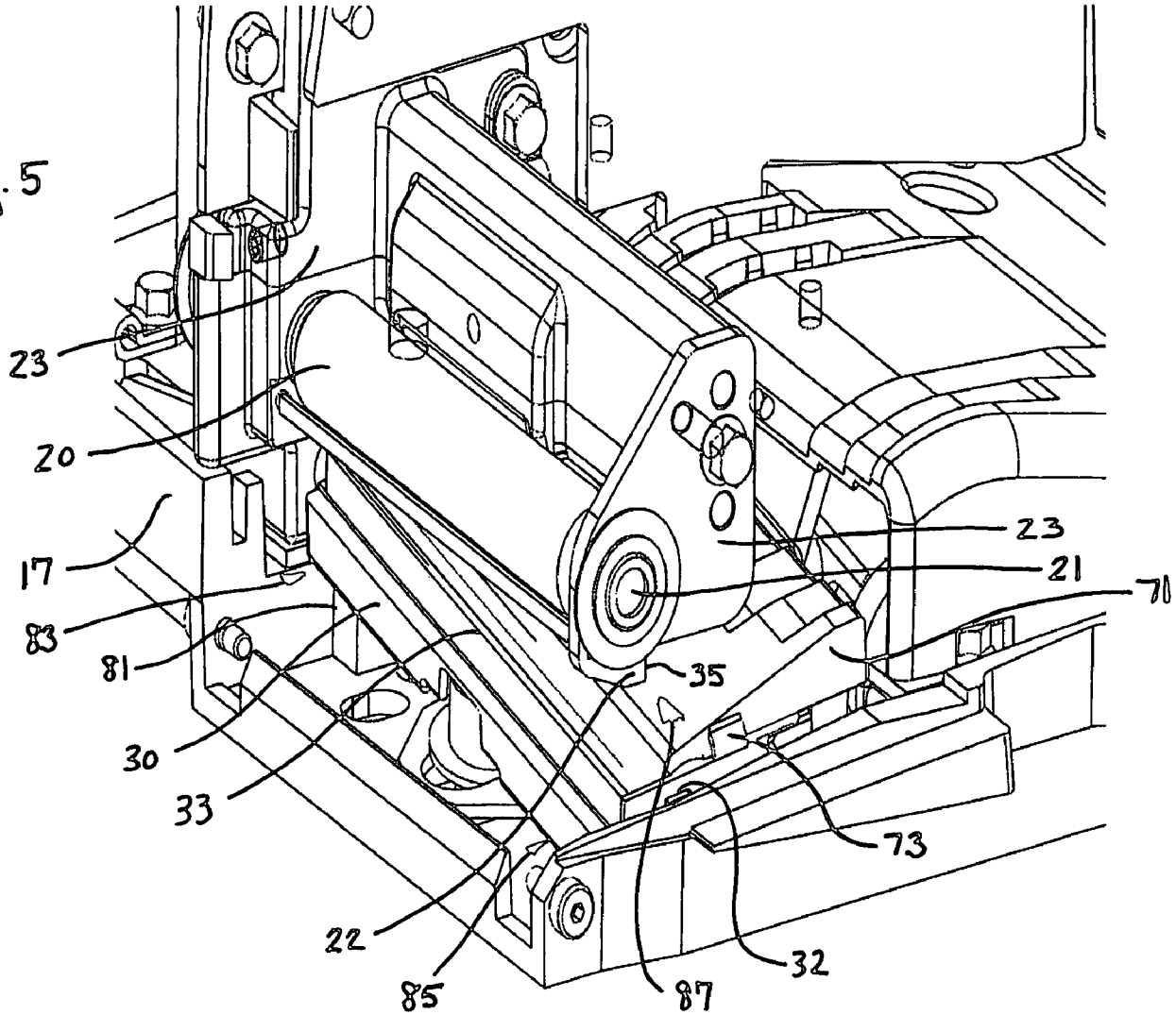
FIG. 5 is a front perspective view of a portion of the print head alignment system of FIG. 1 creating an access space.

As shown in FIG. 1, the illustrated print head alignment system, generally designated 10, includes a print roller assembly 12, a print head support assembly 14 and an actuating assembly 16. FIGS. 4 and 5 illustrate the alignment system positioned within a printer.

The print roller assembly 12 is connected to the frame 17 of the printer and includes a print roller 20, a rod 21 and two spaced apart side plates 23, each with a respective stop 22 (the second stop is not shown). The two plates 23 define two walls of the print roller assembly 12 and each plate 23 includes a hole 25 for receiving the rod 21 and a stop 22 positioned in a lower portion of each plate 23. The print roller 20 is coaxially mounted on the rod 21.

The print head support assembly 14 includes a pivot frame 36, rod 38, heat sink 30 and a print head 33 mounted on the heat sink 30. The pivot frame 36 includes two spaced apart holes 40 located at a rear portion 37 of the pivot frame 36. Rod 38 is received through the holes 40 and is connected to the printer frame 17 (as by threaded bolts) such that the pivot frame 36 is pivotally attached to the printer frame 17 by rod 38 allowing the pivot frame 36 to pivot about a pivot axis of rod 38. The pivot frame 36 further includes two spaced apart wheels 42 rotatably attached to the pivot frame 36 at a central portion of the pivot frame 36. The heat sink 30, having the print head 33 attached thereto, is mounted to the pivot frame 36 at a forward portion 39 of the pivot frame 36.

The heat sink 30 includes two spaced apart detents 32 (the second detent is not shown) located at an upper portion of the heat sink 30. The detents 32 have a surface 34 for engaging a surface 35 of the stops 22 to maintain alignment of the print head 33 with the print roller 20 as shown in FIG. 1.

The heat sink 30 is mounted for movement relative to the pivot frame 36 by a spring-loaded connection 50. The spring-loaded connection 50 permits adjustment of the distance between the heat sink 30 and the rod 38. The spring-loaded connection 50 includes a securing member 52 and a spring 54 disposed about a center pivot shaft 51 that extends forward to the heat sink 30 and about which the heat sink 30 is pivotally connected. The securing member 52 is located at rear portion 37 of the pivot frame 36, with rod 38 extending therethrough, such that the securing member 52 is maintained at the rear portion 37 of the pivot frame 36. The securing member 52 is capable of rotating about the pivot axis of the rod 38. The spring 54 and center shaft 51 connect the securing member 52 to the heat sink 30 such that the heat sink 30, and corresponding print head 33, can both pivot about an axis of the center shaft 51 relative to the pivot frame 36 and move axially along the center shaft.

Figure 7:
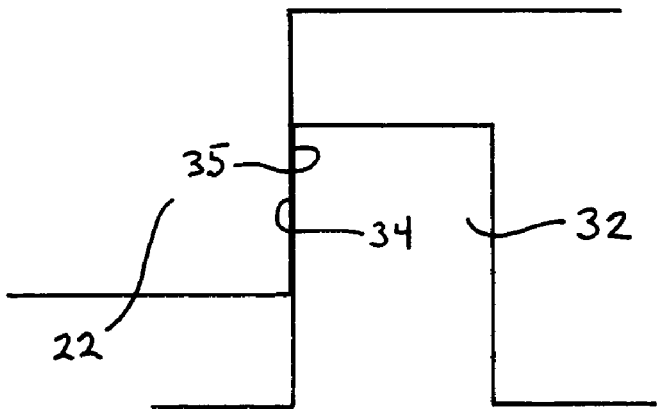
FIG. 7 is a side elevational view of a portion of the print head alignment system of FIG. 6 with the detents engaged with the stops.

The heat sink 30 is connected to the forward portion 39 of the pivot frame 36 by a spring 75 disposed about a shaft, a pressure washer 76 and a lock nut 77, which extends from an opening in the front portion 39 of the pivot frame 36 (see FIGS. 2 and 3), such that some movement of the heat sink 30 relative to the forward portion 39 of the pivot frame is permitted. The spring 75, or other biasing member, urges the heat sink 30 and corresponding print head 33 upward towards the print roller 20. As best seen in FIG. 7, the surface 34 of the detents 32 and the surface 35 of the stops 22 are engaged in a manner that permits the print head 33 to float slightly in the vertical direction, relative to the print roller 20 during operation of the printer if the surfaces 34 of the detents 32 move along the surfaces 35 of the stops 22.

As seen in FIG. 5, the print head support assembly 14 further includes a print head cover 71 located over the top rear portion of the print head 33. The print head cover 71 includes spaced apart lateral guide members 73 that interact with the bottoms of the side plates 23 of the print roller assembly 12 to orient the print head 33 along an axis of the print roller 20 such that the print head is centered on the print roller 20. As shown in FIGS. 4 and 5, a stop 81 is located on the frame 17 and below an inner side 83 of the heat sink 30 to limit downward movement of the inner side 83 of the heat sink 30 and corresponding print head 33 as the print head 33 moves downward away from the print roller 20. However, movement of an outer side portion 85 of the print head 33 is not limited and therefore an access space 87 is created between the print roller 20 and the print head 33, as shown in FIG. 5.

Referring again to FIG. 1, the actuating assembly 16 includes a print head elevator 78 and a manual actuator 79. The print head elevator 78 includes two spaced apart rails 84 for supporting the spaced apart wheels 42 on the print head support assembly 16. Each of the spaced apart rails 84 includes a ramp portion 89 such that the two spaced apart wheels 42 may ride up or down the ramped portion 89 of the rails 84 when the manual actuator 79 moves the print head elevator 78.

Figure 2:
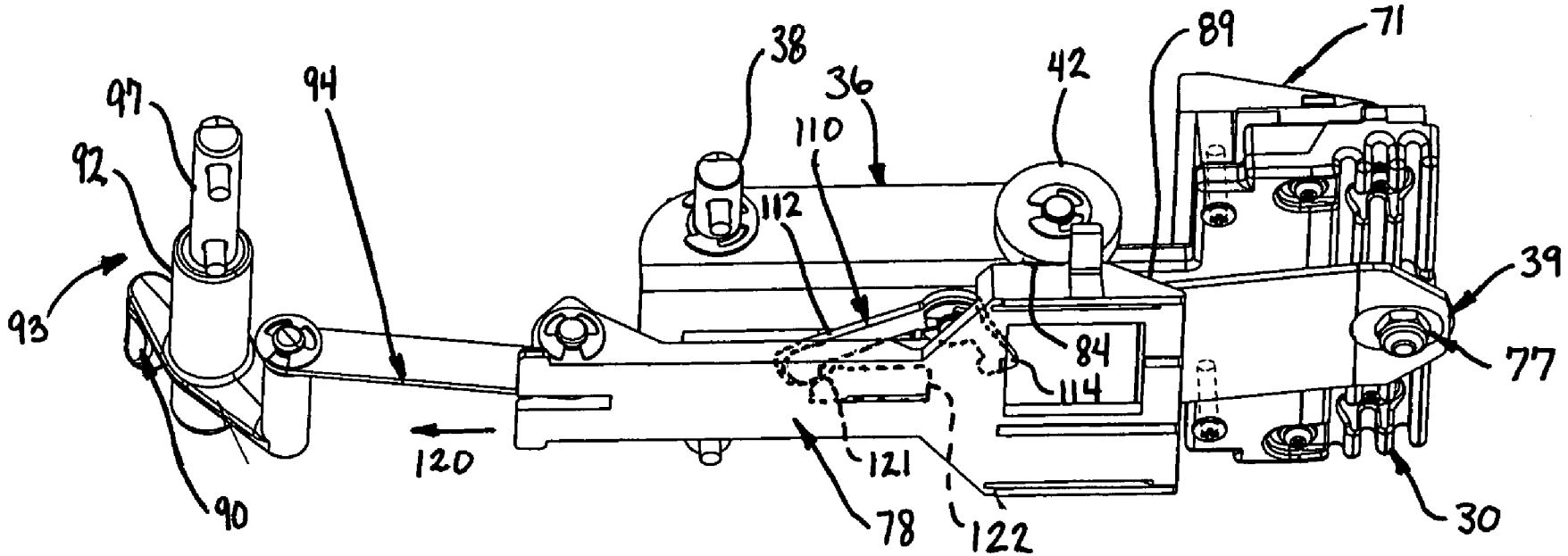
FIG. 2 is a bottom perspective view of the print head alignment system of FIG. 2, with actuating assembly partially actuated.
Figure 3:
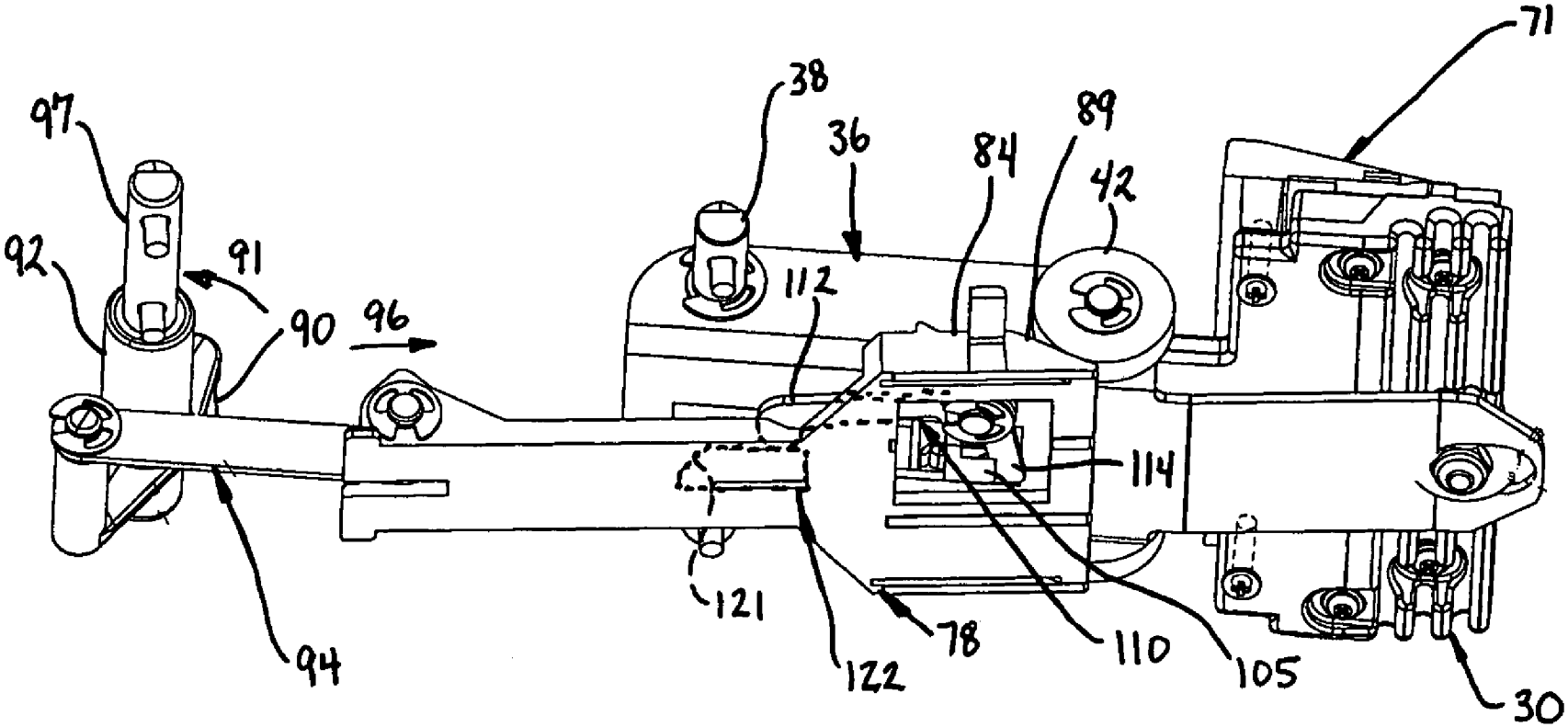
FIG. 3 is a bottom perspective view of the print head alignment system of FIG. 2, with the actuating assembly fully actuated.

Referring to FIGS. 2 and 3, the manual actuator 79 includes a print head lever 90, a print head lever shaft 92, a link 94 and a rod 97. The print head lever 90 is connected to the print head lever shaft 92 that coaxially receives the rod 97. As shown in FIG. 4, the rod 97 is fixedly connected to the printer frame 17 by screws 99 or the like, such that the print head lever shaft 92 may rotate about the rod 97. The print head lever shaft 92 is rotatably connected to the link 94 that in turn is rotatably connected to rear end of the elevator 78. The two spaced apart rails 84 are located at a forward portion 86 of the elevator 78.

Figure 6:
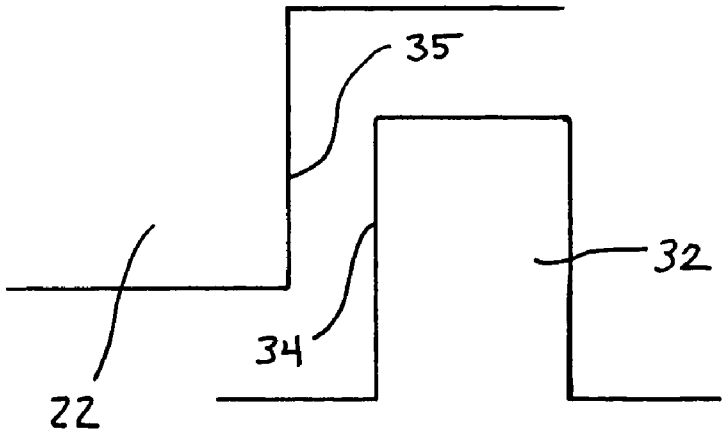
FIG. 6 is a side elevational view of a portion of the print head alignment system of FIG. 6 with the detents engaging the stops.

FIG. 2 represents the orientation of the components when the print head 33 is aligned with the print roller 20 for printing as per FIG. 1, while FIG. 3 represents the orientation of the components when the print head 33 as been disengaged from the print roller 20 to create the print media access space 87 as per FIG. 5. A lever 110, including arms 112 and 114, is positioned between the elevator 78 and the heat sink 30 as shown in FIG. 3, and is pivotally mounted to the underside of the pivot frame 36. The print head 33 is disengaged from the print roller 20 by rotating the print head lever 90 in the direction shown by arrow 93, such that the print head lever shaft 92 rotates about the rod 97 and moves the link 94 in the direction shown by arrow 120 (FIG. 2), thereby withdrawing the elevator 78 in the direction 120. As the elevator 78 moves in direction 120, a cam surface 121 of a projection 122 that extends upward from the elevator 78 interacts with arm 112 of the lever 110 causing the lever to rotate from the position of FIG. 2 toward the position of FIG. 3. The rotation of the lever 110 causes arm 114 to interact with contact portion 105 of the heat sink 30, thereby pulling the heat sink 30 away from the print roller assembly 14 (direction 120) so that the detents 32 first back off from the stops 22 into the position reflected in FIG. 6 before the print head 33 moves downward away from the print roller 20. As the elevator 78 continues to be withdrawn in the direction 120, the surface of the elevator projection 122 is arranged so that the lever 110 stops rotating but is maintained in position to hold the detents 32 in the backed off position from the stops 22. Next, the pivot frame wheels 42 ride down the ramp 89, as reflected in FIG. 3, and the print head 33, the heat sink 30 and the pivot frame 36 rotate about a pivot axis defined by the axis of rod 38. At the same time the heat sink 30 rotates about the axis of center pivot shaft 51, thereby creating access space 87 between the print head 33 and the print roller 20 by causing the outer side of the print head support assembly to drop down away from the print roller as per FIG. 5.

Engagement of the print head 33 with the print roller 20 is basically a reverse of the sequence described above. When the print head lever 90 is rotated in the direction shown by arrow 91 (FIG. 3), the print head lever shaft 92 rotates about the rod 97 thereby moving the link 94 in a forward direction shown by arrow 96, thereby advancing the elevator 78 in the forward direction 96. As the elevator 78 advances in the forward direction 96, the wheels 42 on the print head support assembly 14 ride up the ramp portions 89 of the rails 84 to move the detents 32 upward into the position shown in FIG. 6. As the elevator 78 is moved further in direction 96, the cam surface 121 of elevator projection 122 permits the lever 110 to rotate back toward the position reflected in FIG. 2, allowing the detents to move forward into the position against the stops as shown in FIG. 7. In one embodiment the bias of spring 54 may be sufficient to automatically move the print head support assembly forward when the lever 110 rotates to the position of FIG. 2. In another embodiment, the detents 32 may remain in the backed off position of FIG. 6 until the print roller 20 is operated to feed label stock, with the movement of the label stock interacting with the print head 33 to pull the print head support assembly forward so that the detents 32 engage the stops 22 as shown in FIG. 7. When the elevator 78 is in the fully actuated, forward position, the spring 75 may bias the heat sink 30 and corresponding print head 33 to maintain proper engagement with the print roller 20.

Although a specific embodiment is shown and described above, equivalents and modifications will occur to those skilled in the art upon reading and understanding this specification. For example, while the illustrated embodiment contemplates that the print roller assembly is in a fixed position within the printer and the print head support assembly is moved to create the media access space, it is recognized that embodiments in which the print head and heat sink are fixed and the print roller assembly is moved to create the medic access space are possible, in which case the pivot frame and elevator could be associated with the print roller assembly to cause the stops 22 to move away from the detents 32 before the print roller moves away from the print head. Further, while the print roller assembly is shown in an orientation placing the print roller above the print head, it is recognized that other orientations are possible, including orientations in which the print head is above the print roller. The present application includes all such modifications and variations and is limited only by the scope of the claims.

What is claimed is:

1. A printer for printing between a print roller and a print head, comprising:

a print head alignment system including:

a print roller assembly having a print roller mounted thereon and at least one stop;

a print head support assembly having a print head mounted thereon and at least one detent, a surface of said detent engaging a surface of said stop to maintain alignment of said print head with said print roller;

an actuating assembly associated with one of said print head support assembly and said print roller assembly for movement thereof so as to back one of the detent and the stop away from the other of the detent and the stop before moving the one of said print head support assembly and said print roller assembly so as to provide an access space between said print head and said print roller for allowing print media to be removed and inserted;

wherein the actuating assembly is connected to move said print head support assembly and operates to back said detent off of said stop before moving at least one side of the print head away from the print roller to provide the access space;

wherein said print head support assembly includes a pivot frame pivotally attached toward one end to pivot about a pivot axis;

wherein said pivot frame includes two spaced apart wheels rotatably attached thereto.

2. The printer of claim 1 wherein said print head support assembly includes a heat sink to which said print head is mounted, said heat sink is mounted for movement relative to said pivot frame to adjust a distance between said print head and said pivot axis.

3. The printer of claim 1 wherein said actuating assembly includes a print head elevator positioned beneath said pivot frame and having spaced apart rails on which said wheels are supported.

4. The printer of claim 3 wherein said actuating assembly includes a manual actuator for moving said print head elevator relative to said print head support assembly.

5. The printer of claim 1 wherein the surface of the detent and the surface of the stop surface are engaged in a manner that permits the print head to float relative to the print roller during operation when the surface of the detent moves along the surface of the stop.

6. The printer of claim 5 wherein the print head support assembly includes a biasing member for urging the print head toward the print roller.

7. A printer for printing between a print roller and a print head, comprising:

a print head alignment system including:

a print roller assembly having a print roller mounted thereon and at least one stop;

a print head support assembly having a print head mounted thereon and at least one detent, a surface of said detent engaging a surface of said stop to maintain alignment of said print head with said print roller;

an actuating assembly associated with one of said print head support assembly and said print roller assembly for movement thereof so as to back one of the detent and the stop away from the other of the detent and the stop before moving the one of said print head support assembly and said print roller assembly so as to provide an access space between said print head and said print roller for allowing print media to be removed and inserted;

a stop located below a first side of said print head support assembly to limit downward movement of an inner side of the print head away from said print roller while an outer side of the print head moves to create the access space:

wherein the actuating assembly is connected to move said print head support assembly and operates to back said detent off of said stop before moving at least one side of the print head away from the print roller to provide the access space;

wherein said print head support assembly includes a pivot frame that pivots about a first axis, and said print head is pivotally connected with said pivot frame to pivot about a second axis.

8. A printer for printing between a print roller and a print head, comprising:

a print head alignment system including:

a print roller assembly having a print roller mounted thereon and at least one stop;

a print head support assembly having a print head mounted thereon and at least one detent, a surface of said detent engaging a surface of said stop to maintain alignment of said print head with said print roller; and an actuating assembly associated with one of said print head support assembly and said print roller assembly for movement thereof so as to back one of the detent and the stop away from the other of the detent and the stop before moving the one of said print head support assembly and said print roller assembly so as to provide an access space between said print head and said print roller for allowing print media to be removed and inserted;

wherein the print head support assembly includes spaced apart lateral guide members that interact with the lateral guide portions of the print roller assembly to orient the print head along an axis of the print roller.

9. A printer for printing between a print roller and a print head, comprising:

a print head alignment system including:

a print roller assembly having a print roller mounted thereon and at least one stop;

a print head support assembly having a print head mounted thereon and at least one detent, a surface of said detent engaging a surface of said stop to maintain alignment of said print head with said print roller; and an actuating assembly associated with one of said print head support assembly and said print roller assembly for movement thereof so as to back one of the detent and the stop away from the other of the detent and the stop before moving the one of said print head support assembly and said print roller assembly so as to provide an access space between said print head and said print roller for allowing print media to be removed and inserted;

wherein said actuating assembly includes a movable cam surface that interacts with a lever.

10. The printer of claim 9 wherein the actuating assembly is connected to move said print roller assembly and operates to back said stop off of said detent before moving at least one side of the print roller away from the print head to provide the access space.

11. A print head alignment system, comprising:

a frame;

a print roller support extending from said frame and having at least one stop and a print roller;

a print head support assembly including a pivot frame pivotally attached toward one end to pivot around a pivot axis, two spaced apart wheels rotatably attached to said pivot frame, and a heat sink supporting a print head and having at least one detent, said heat sink mounted for movement relative to said pivot frame to permit a distance between the print head and the pivot axis to be varied; and a print head elevator having two spaced apart rails for supporting said spaced apart wheels, each of said spaced apart rails including a respective ramp portion, said print head elevator being moveable relative to said pivot frame in a first direction causing said wheels to ride up said ramp portions to elevate said print head and heat sink and place said at least one detent into vertical alignment with said at least one stop.

12. The print head alignment system of claim 11 further comprising a manual actuator associated with said print head elevator for effecting movement of said print head elevator.

13. The print head alignment system of claim 11 wherein a biasing member is positioned between said heat sink and a forward portion of said pivot frame to urge said print head upward toward said print roller.

14. The print head alignment system of claim 11 wherein said print head elevator is movable in a second direction causing said wheels to ride down said ramp portions such that at least one side of the print head moves downward from the print roller creating an access space between the print roller and print head enabling print media to be inserted or removed.

15. The print head alignment system of claim 14 wherein a lever is positioned between said print head elevator and said heat sink, a portion of said print head elevator moves said lever when said print head elevator moves in the second direction and said lever responsively pulls said heat sink toward said pivot frame, thereby backing the detent off from the stop before the access space is created.

16. The print head alignment system of claim 11 wherein a biasing member is positioned to urge said heat sink away from said pivot frame.

17. The print head alignment system of claim 16 wherein, after said at least one detent is moved into vertical alignment with said at least one stop, feeding of label stock between the print roller and print head causes said at least one detent to engage said at least one stop.

18. In a printer, a method of disengaging a print head support assembly and a print roller assembly, wherein said print roller assembly includes at least one substantially vertical stop surface engaged with at least one substantially vertical detent surface of said print head support assembly maintaining alignment of a print head and a print roller, said method comprising the steps of:

(a) moving one of said print head support assembly and said print roller assembly in a first direction to space said detent surface from said stop surface;

(b) after step (a), moving at least one side of said one of said print head support assembly and said print roller assembly in a second direction away from the other of said print head support assembly and said print roller assembly to provide an access space between said print head and said print roller for allowing print media to be removed and inserted;

wherein step (a) involves moving a lever to pull a portion of said one of said print head support assembly and said print roller assembly.

19. The method of claim 18 wherein said lever is moved by engagement with a cam surface.

20. The method of claim 19 wherein the cam surface is located on a sliding member that is moved during step (a).

21. The method of claim 20 wherein the said print head support assembly is moved and said sliding member comprises a print head elevator positioned below said print head support assembly and moved responsive to manual actuation of a handle.

22. The method of claim 18 wherein said first direction is substantially perpendicular to said second direction.

23. A printer for printing between a print roller and a print head, comprising:

a print head alignment system including:

a print roller assembly having a print roller mounted thereon and having a pair of spaced apart stops;

a print head support assembly having a print head mounted thereon and a pair of spaced apart detents aligned with said pair of spaced apart stops, each of said detents has a substantially planar surface engaged with a corresponding substantially planar surface of one of said stops to maintain alignment of said print head with said print roller when said print roller and print head are oriented for printing; and an actuating assembly associated with one of said print head support assembly and said print roller assembly for movement thereof so as to back one of the pair detents and the pair of stops away from the other of the pair of detents and the pair of stops before moving the one of said print head support assembly and said print roller assembly so as to provide an access space between said print head and said print roller for allowing print media to be removed and inserted.

* * * * *